US010787313B1

(12) United States Patent
Hogan

(10) Patent No.: US 10,787,313 B1
(45) Date of Patent: Sep. 29, 2020

(54) COLLECTION RECEPTACLE APPARATUS

(71) Applicant: David W. Hogan, Murrells Inlet, SC (US)

(72) Inventor: David W. Hogan, Murrells Inlet, SC (US)

( * ) Notice: Subject to any disclaimer, the term of this patent is extended or adjusted under 35 U.S.C. 154(b) by 0 days.

(21) Appl. No.: 16/290,280

(22) Filed: Mar. 1, 2019

Related U.S. Application Data

(60) Provisional application No. 62/637,073, filed on Mar. 1, 2018.

(51) Int. Cl.
*B65B 67/04* (2006.01)
*B65F 1/14* (2006.01)
*A47L 13/52* (2006.01)

(52) U.S. Cl.
CPC ..... *B65F 1/1415* (2013.01); *A47L 13/52* (2013.01); *B65F 2240/138* (2013.01)

(58) Field of Classification Search
CPC ..... B65B 67/12; B65B 67/1233; B65F 1/10
See application file for complete search history.

(56) References Cited

U.S. PATENT DOCUMENTS 4,550,440 A * 10/1985 Rico ..... B65B 67/1233 141/108
4,709,440 A * 12/1987 Conelly ..... E01H 1/006 15/257.3
5,031,948 A * 7/1991 Groth ..... B65B 67/1233 141/108
5,106,041 A 4/1992 Jelincic
5,308,027 A * 5/1994 Fullilove ..... B65B 67/12 248/101
5,502,871 A 4/1996 Reyes
5,593,117 A 1/1997 Alexander, III
5,785,369 A 7/1998 Ridley, Sr. et al.
5,878,461 A 3/1999 Killian
D429,609 S 8/2000 Azevedo
6,155,522 A 12/2000 Anderson
6,708,742 B2 3/2004 Weathers et al.
D513,352 S 12/2005 Weathers et al.
6,974,167 B2 * 12/2005 Springs, II ..... B65F 1/10 15/257.1
6,983,965 B1 1/2006 Bergell
7,007,991 B1 3/2006 Sapp
D567,465 S 4/2008 Lucker
7,744,044 B2 * 6/2010 Gabriel ..... B65B 67/12 248/101
7,975,732 B2 * 7/2011 Schoniger ..... B65B 67/1233 141/10
8,959,704 B1 2/2015 Pena
2002/0100844 A1 * 8/2002 Green ..... B65B 67/12 248/99
2008/0052869 A1 3/2008 Fanning

* cited by examiner

*Primary Examiner* — Amy J. Sterling
(74) *Attorney, Agent, or Firm* — P. Jeff Martin; The Law Firm of P. Jeffrey Martin, LLC

(57) ABSTRACT

A collection receptacle apparatus includes a base having a sloped surface and a horizontal surface for engaging the opening of a disposable receptacle. The apparatus includes a receptacle attachment member having a pair of vertical members depending from the base, the vertical members coupled via a horizontal member. Attachment means is used to connect or couple the disposable receptacle (e.g., trash bag) to the receptacle attachment member.

12 Claims, 7 Drawing Sheets

COLLECTION RECEPTACLE APPARATUS

I. RELATED APPLICATIONS

This application claims priority to U.S. Provisional Patent Application No. 62/637,073, filed on Mar. 1, 2018, the disclosure of which is hereby incorporated by reference in its entirety.

II. FIELD OF THE INVENTION

The present application discloses and describes a collection receptacle apparatus.

III. MOTIVATION OF THE INVENTOR

Many apparatuses, systems, and methods have been attempted to collect loose articles and items, especially for gathering and collecting debris into a disposable storage receptacle. For example, there are several variants of chutes that are utilized with a lawn rake or brush to collect and then deposit the gathered lawn debris into a storage receptacle. The variants include chutes with various slopes and dimensions, as well as variants of the rake(s) and/or brush(es) that exist, including standard leaf rakes with an elongated handle or leaf rakes that are mounted to a user's hands.

A search of the prior art did not disclose any patents that read directly on the claims of the instant invention; however, the following references were considered related:

U.S. Pat. No. 5,106,041, issued in the name of Jelincic;

U.S. Pat. No. 5,502,871, issued in the name of Reyes;

U.S. Pat. No. 5,593,117, issued in the name of Alexander, III;

U.S. Pat. No. 5,785,369, issued in the name of Ridley, Sr. et al.;

U.S. Pat. No. 5,878,461, issued in the name of Killian;

U.S. Pat. No. 6,155,522, issued in the name of Anderson;

U.S. Pat. No. 6,708,742 B2, issued in the name of Weathers et al.;

U.S. Pat. No. 6,983,965 B1, issued in the name of Bergell;

U.S. Pat. No. 7,007,991 B1, issued in the name of Sapp;

U.S. Pat. No. 8,959,704 B1, issued in the name of Pena;

U.S. Patent Application no. 2008/0052869 A1, published in the name of Fanning;

U.S. Pat. No. D429,609, issued in the name of Azevedo;

U.S. Pat. No. D567,465 S. issued in the name of Lucker; and

U.S. Pat. No. D513,352 S, issued in the name of Weathers et al.

Accordingly, there is a need for an apparatus, system, and/or method that provides an improved device for gathering, collecting, and disposing of debris, including natural items (e.g., leaves, grass clippings) and man-made items (e.g., disposable container cartons).

This application presents claims and embodiments that fulfill a need or needs not yet satisfied by the products, inventions and methods previously or presently available. In particular, the claims and embodiments disclosed herein describe a collection receptacle apparatus, the apparatus comprises an elongated base member having a sloped front edge which extends into a horizontal upper surface section opposing a bottom surface; a receptacle attachment member and a coupling means for releasably attaching a mouth portion of a collection receptacle to the receptacle attachment member; and a pair of adjustable, distally-oriented vertical members secured to the horizontal upper surface section, the pair of vertical members is integrally joined by an elongated horizontal member; wherein the collection receptacle apparatus of the present invention providing unanticipated and nonobvious combination of features distinguished from the devices, apparatuses, inventions and methods preexisting in the art. The applicant is unaware of any device, apparatus, method, disclosure or reference that discloses the features of the claims and embodiments disclosed herein, and as more fully described below.

IV. SUMMARY OF THE INVENTION

A collection receptacle apparatus is disclosed. In accordance with one embodiment of the present invention, the apparatus comprises an elongated base member having a sloped front edge which extends into a horizontal upper surface section opposing a bottom surface. The apparatus further comprises a receptacle attachment member and a coupling means for releasably attaching a mouth portion of a collection receptacle to the receptacle attachment member.

A pair of distally-oriented vertical members is secured to the horizontal upper surface. The pair of vertical members is integrally coupled by an elongated horizontal member. A mouth portion a collection receptacle is opened and releasably attached in an opened condition around the collection receptacle attachment member via an attachment means. Each one of the pair of vertical members is telescopically adjustable.

V. BRIEF DESCRIPTION OF THE DRAWING(S)

VI. DESCRIPTION OF THE EMBODIMENT(S)

Figure 1:
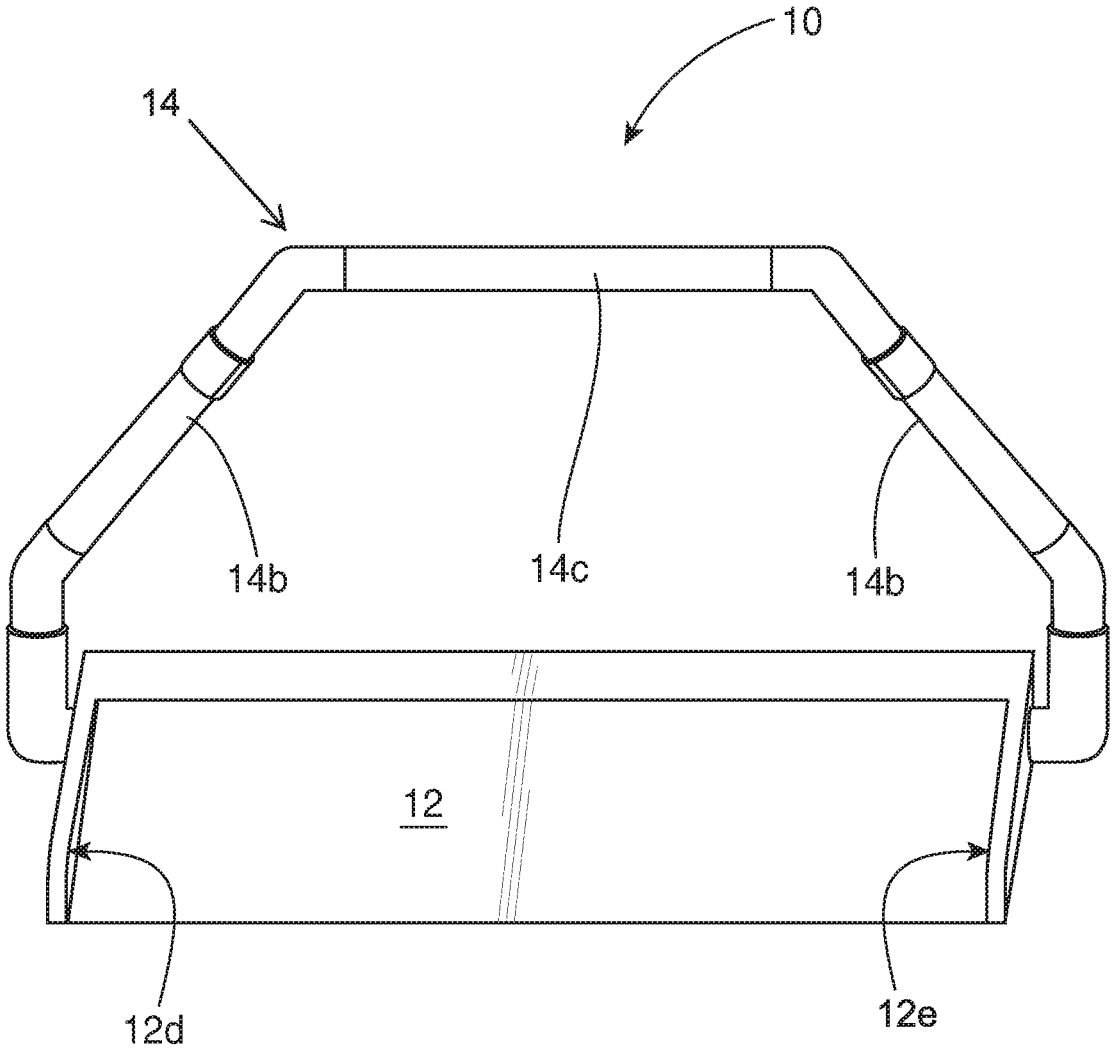
FIG. 1 is a front perspective view of a collection receptacle apparatus.

In accordance with the drawings illustrating at least one embodiment, as generally depicted in FIG. 1 through FIG. 7, a collection receptacle apparatus 10 comprises an elongated base member 12. The base 12 has a sloped front edge 12*a* that is mutually coextensive with and/or extends into a horizontal upper surface section 12*b*. The upper surface 12*b* is in mutual opposition to a bottom surface section 12*c*. A receptacle attachment member 14 depends from the base 12. The receptacle attachment member 14 serves multiple functions, including for maneuvering the apparatus 10 as well as for coupling a separate collection receptacle (R) (such as a plastic garbage bag) for collecting debris or loose items. Coupling means 16 couples the collection receptacle (R) with the attachment member 14.

It is envisioned that the base 12 may comprise a variety of configurations without departing from the spirit of this description and disclosure. For example, the sloped front edge 12*a* may comprise a variety of dimensional widths, including a front edge 12*a* that is wider than the upper surface 12*b*, a front edge 12*a* that is substantially similar in width to the upper surface 12*b*, and/or a front edge that is narrower than the width of the upper surface 12*b*. In another embodiment, the leading margin of the front edge 12*a* may include a bumper or lift that assists in sliding or moving debris from the native surface onto the sloped surface 12*a* and the upper surface 12*b*, respectively. In another embodiment, the sloped surface 12*a* and/or the upper surface 12*b* may comprise surface material that enhances and/or promotes efficient sliding or movement of debris from the native surface onto the sloped 12*a* and/or upper surfaces 12*b*. A transition or margin 12*c* may be indicated between the sloped surface 12*a* and the upper surface 12*b*.

The base 12 may further include a first sidewall 12*d* and a second sidewall 12*e* aligned along either side of the sloped surface 12*a*, each one of the sidewalls 12*d* and 12*e* is upwardly depending and/or extending sidewall that assists in guiding the targeted article(s), item(s), and/or debris through the sloped surface 12*a* and to minimize spillage and improve efficiency. Intermediately disposed between sidewalls 12*d* and 12*e* is a rear brace 12*f* with multi-sides and surfaces. The horizontal upper surface section 12*b* is the exposed upper surface of rear brace 12*f*.

The receptacle attachment member 14 may have a variety of configurations. For example, in one embodiment, receptacle attachment member 14 comprises a unified, single-piece unit. It is envisioned that this single-piece receptacle attachment member 14 articulates along a means for pivoting 14*a*.

In another embodiment, consistent with FIGS. 1-3 and 6, receptacle attachment member 14 comprises a plurality of elements, including a pair of distally-oriented vertical members 14*b* with a horizontal member 14*c* intermediately disposed between the vertical members 14*b*. The vertical members 14*b* may insert into the base 12 at a variety of locations. In one embodiment, the vertical members 14*b* may insert into the base 12 via the sidewalls 12*d* and 12*e*. In another embodiment, the vertical members 14*b* may insert into the horizontal upper surface 12*b* (and the exposed upper surface of rear brace 12*f*).

Figure 3:
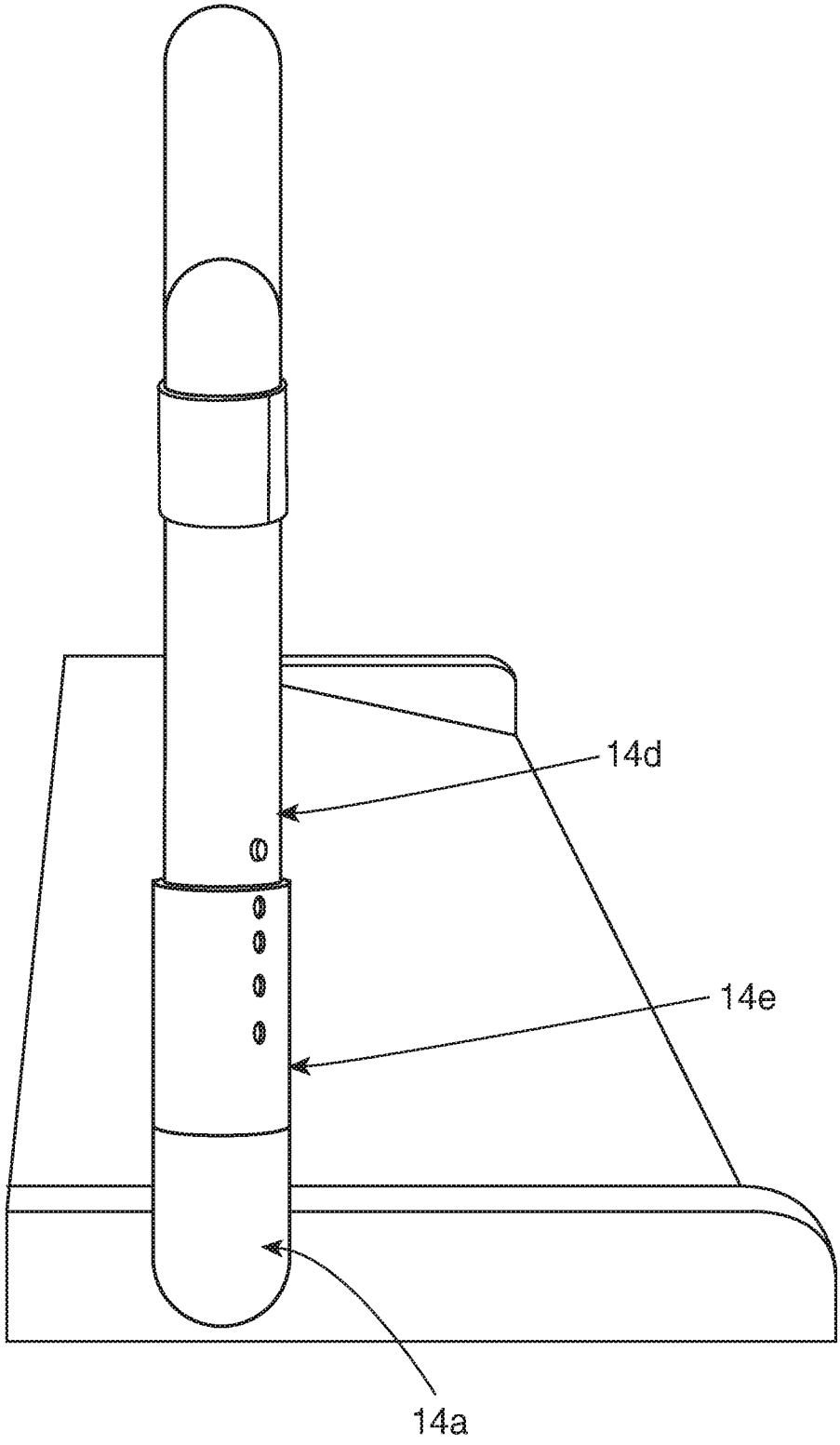
FIG. 3 is side-view opposite to the view of the apparatus depicted in FIG. 2.
Figure 4:
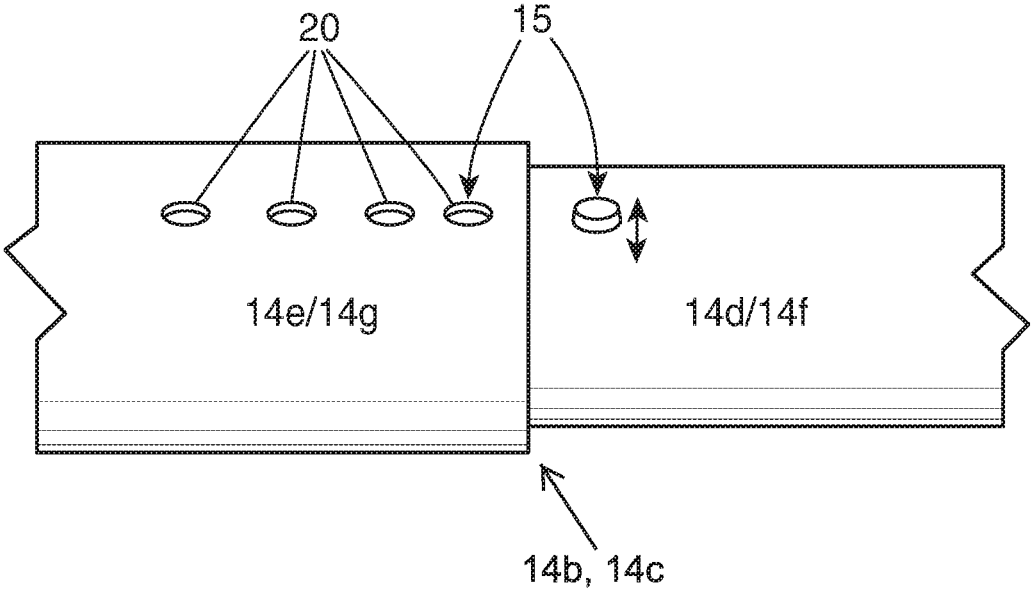
FIG. 4 is a front view of an inner vertical or horizontal member telescopically arranged and movable about an outer vertical or horizontal member using adjustment means, such as an outwardly biased spring-loaded button and indexing holes.
Figure 5:
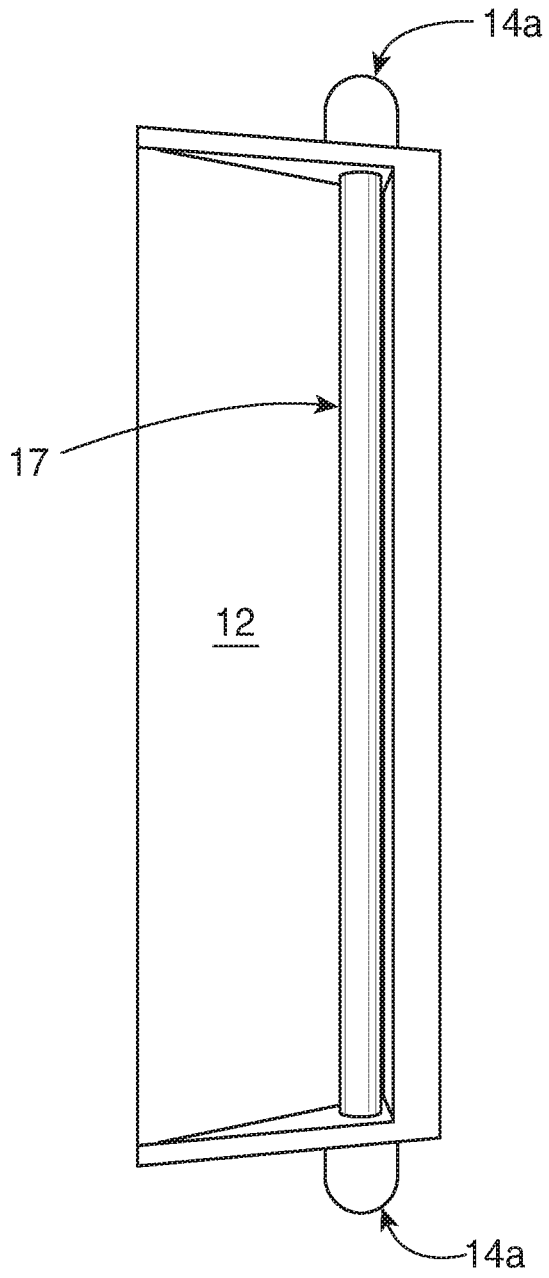
FIG. 5 is the underside view of the apparatus.
Figure 6:
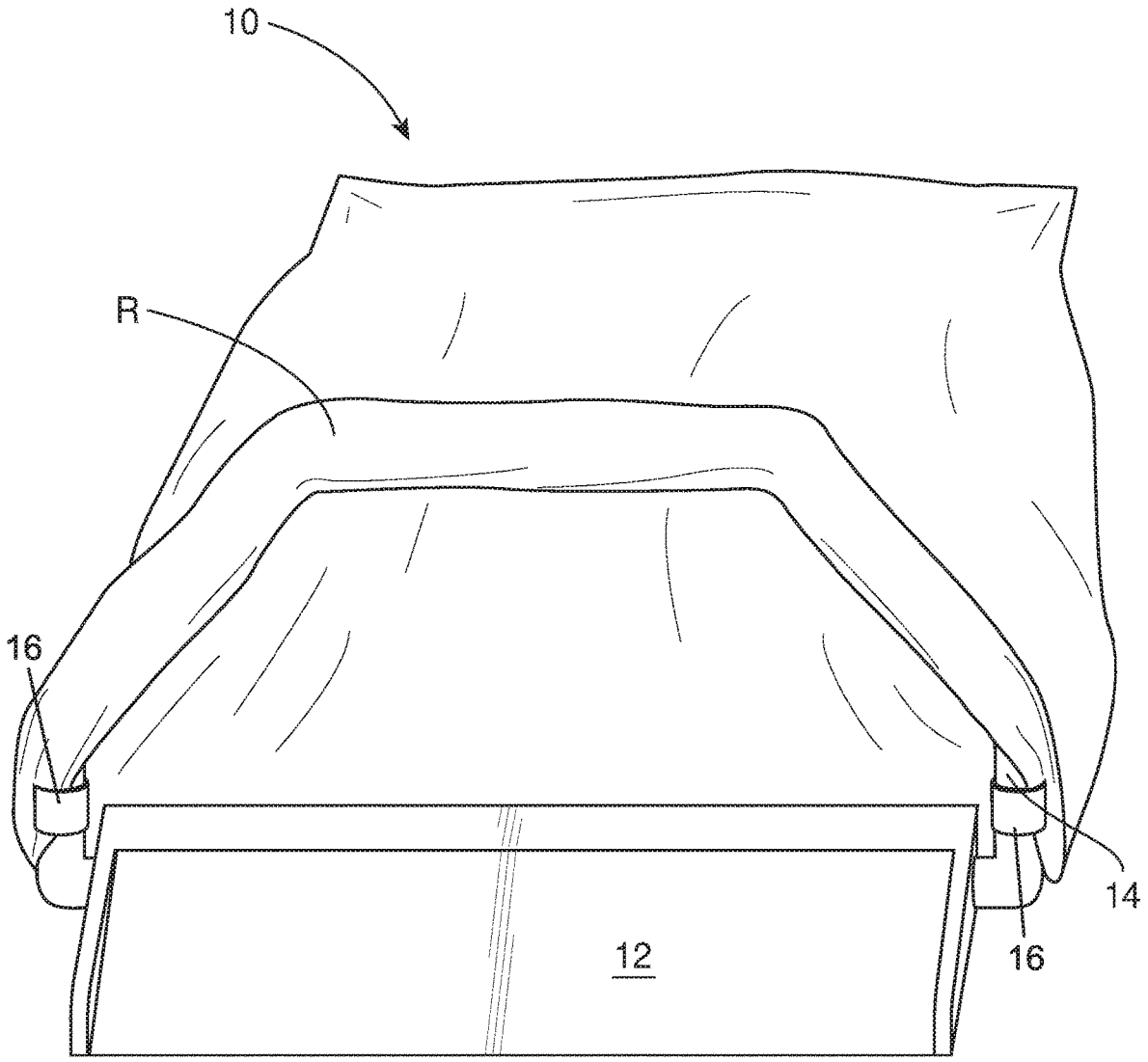
FIG. 6 is an alternate embodiment wherein the distally-oriented vertical members are inserted through the upper surface.

Referring now more particularly to FIG. 3, an anchor device 30 is provided for securing the apparatus 10 in position during use. The anchor device 30 is envisioned to be pivotally secured to opposing sidewalls 12*d* and 12*e*. The anchor device 30 includes an elongated appendage with a pointed lower end for insertion into the ground. Other anchoring devices and mechanisms are envisioned and therefore are within the spirit and scope of the present invention. For example, a stake engaged through the hole of a flange, the flange extending integrally radially from the sidewalls 12*d* and 12*e*.

It is envisioned that each one of the pair of distally-oriented vertical members 14*b* and the horizontal member 14*c* are separately linearly adjustable. In one embodiment, the vertical members 14*b* may comprise an inner vertical member 14*d* and an outer vertical member 14*e*, wherein the vertical members 14*d* and 14*e* are adjustable and coupled via adjustment means 15. In such an embodiment, the outer vertical member 14*e* has a diameter greater than the inner vertical member 14*d*, thereby allowing the inner vertical member 14*d* to adjustably slide into and out from the inner diameter of the outer vertical member 14*e*. It is also envisioned that the vertical members 14*b* articulate along means for pivoting 14*a*.

Similarly, the horizontal member 14*c* may comprise an inner horizontal member 14*f* and an outer horizontal member 14*g*, wherein the horizontal members 14*f* and 14*g* are adjustable and coupled via adjustment means 15. It is envisioned that a variety of adjustment means 15 may be used to achieve telescoping movement and securement, including friction impingement utilizing a depressible button outwardly biased via a spring and residing on or within the inner vertical member 14*d* or the inner horizontal member 14*f*, respectively and as applicable. The button is adjustable along a plurality of indexing holes 20 (shown in FIG. 4) provided along the outer vertical member 14*e* or outer horizontal member 14*g*, respectively.

Figure 2:
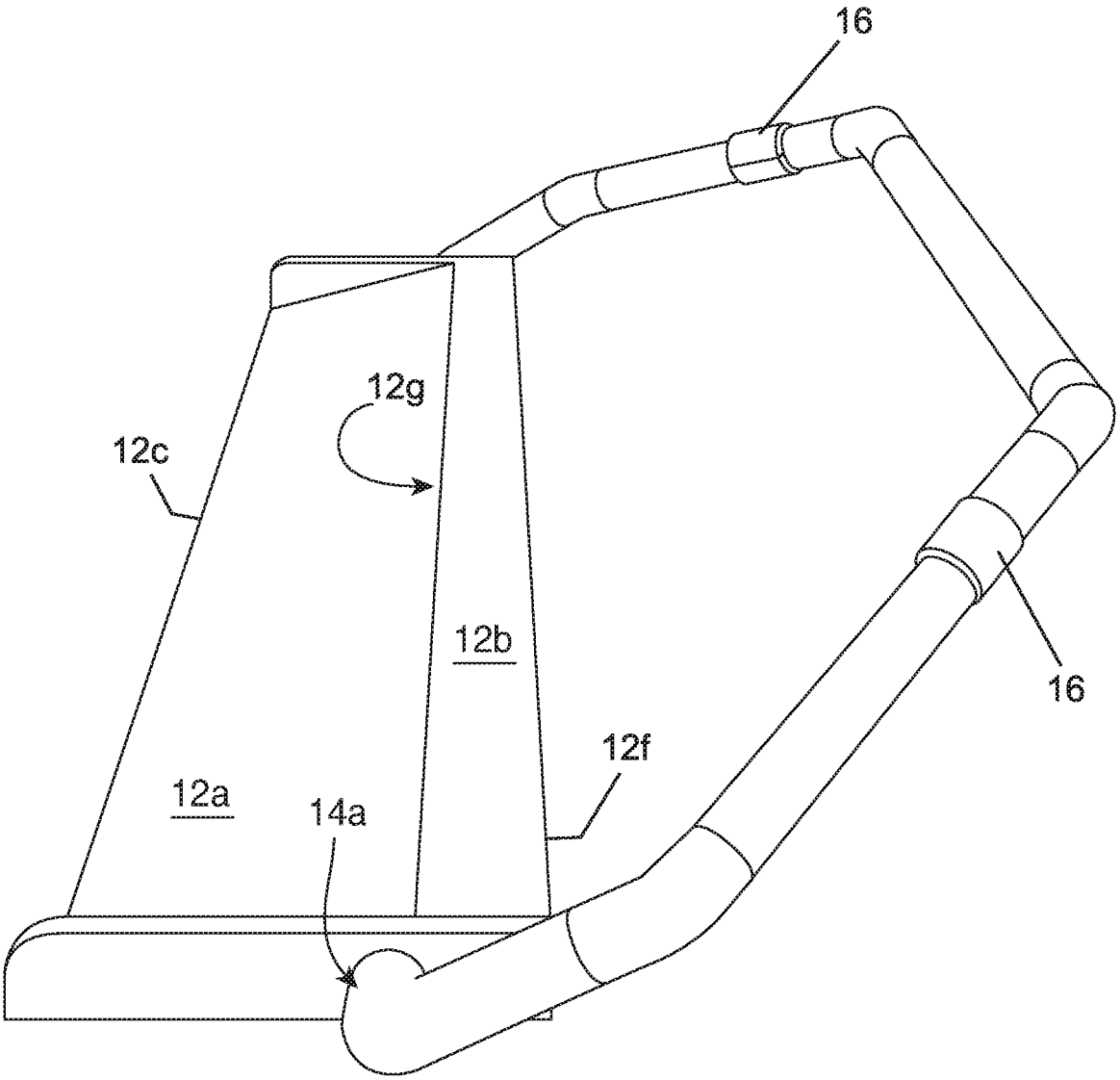
FIG. 2 is a side view of the apparatus of FIG. 1 depicting the receptacle attachment means in a different position articulated along pivot means.

Consistent with FIGS. 2 and 3, pivoting means 14*a* may comprise a variety of elements. In one embodiment, pivoting means 14*a* may comprise an articulating connector or hinge, or other suitably similar apparatus. In another embodiment, pivoting means 14*a* may comprise a linearly elongated shaft 17 (FIG. 5) intermediately disposed between the opposing vertical members 14*b* along insertion points into the base 12.

Figure 7:
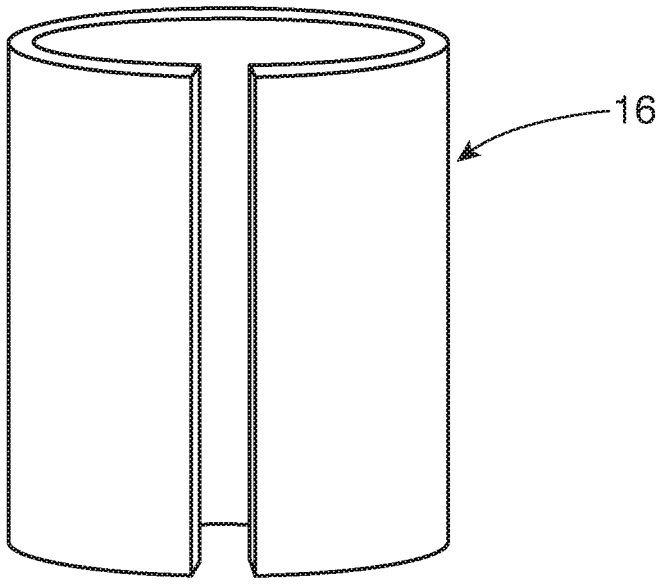
FIG. 7 is a perspective view of one embodiment of attachment means, depicted as a C-shaped clamp of returnably resilient material.

As best seen in FIG. 7, coupling means 16 is provided for releasably attaching the mouth portion of the collection receptacle (R) to the receptacle attachment member 14. Coupling means 16 may comprise a variety of configurations. In one embodiment, coupling means 16 may comprise a C-shaped clamp, adjustable to allow a user to manipulate the collection receptacle (R) boundary or edge so that the C-shaped clamp will impinge the receptacle (R) with the receptacle attachment member 14. In one embodiment, the C-shaped clamp comprises a returnably resilient material.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A collection receptacle apparatus comprising:

an elongated base member having a sloped front edge extending into a horizontal upper surface section opposing a bottom surface, the horizontal upper surface section terminating integrally at an upwardly-extending rear wall;

a receptacle attachment member;

a coupling means for releasably attaching a mouth portion of a collection receptacle to the receptacle attachment member;

wherein the collection receptacle attachment member comprises a pair of distally-oriented vertical members secured to the horizontal upper surface, the pair of vertical members is integrally coupled by an elongated horizontal member, and wherein the mouth of the collection receptacle is opened and releasably attached in an opened condition around the collection receptacle attachment member via the coupling means; and a pivoting means about which the pair of vertical members articulates.

2. The apparatus of claim 1, wherein the coupling means comprises a returnably resilient clamp.

3. The apparatus of claim 1, wherein the sloped front edge of the base member provides an inclined ramp.

4. The apparatus of claim 1, wherein the elongated horizontal member comprises an inner horizontal member and an outer horizontal member mutually telescopic along an adjustment means.

5. The apparatus of claim 1, wherein each one of the pair of vertical members comprises an inner vertical member and an outer vertical member mutually telescopic along an adjustment means.

6. The apparatus of claim 1, wherein the pivoting means comprises a linearly elongated shaft intermediately disposed between the pair of vertical members and extending through the base member.

7. A lawn and garbage collection receptacle apparatus comprising:

an elongated base member having a sloped front edge extending into a horizontal upper surface section opposing a bottom surface;

a pair of upwardly-extending opposing sidewalls, the sidewalls integrally joined by an upwardly-extending rear wall, the upwardly-extending rear wall comprises an exposed upper surface defined as the horizontal upper surface section;

a collection receptacle attachment member;

a coupling or attachment means for releasably attaching a mouth portion of a garbage collection receptacle to the attachment member;

wherein the plurality of collection receptacle attachment members may comprise a pair of distally-oriented vertical members secured to the horizontal upper surface and adjacent lateral sides of the base member, the pair of vertical members are integrally joined by an elongated horizontal member, and wherein the mouth of the collection receptacle is opened and releasably attached in an opened condition around the plurality of collection receptacle attachment members via the attachment means; and a pivoting means about which the pair of vertical members articulates.

8. The apparatus of claim 7, wherein attachment means comprises a returnably resilient clamp.

9. The apparatus of claim 7, wherein the sloped front edge of the base member provides an inclined ramp.

10. The apparatus of claim 7, wherein the elongated horizontal member comprises an inner horizontal member and an outer horizontal member mutually telescopic along adjustment means.

11. The apparatus of claim 7, wherein each one of the pair of vertical members comprises an inner vertical member and an outer vertical member mutually telescopic along adjustment means.

12. The apparatus of claim 7, wherein the pivoting means comprises a linearly elongated shaft intermediately disposed between the pair of vertical members and extending through the base member.

* * * * *